US011173407B2

(12) United States Patent
Huang et al.

(10) Patent No.: US 11,173,407 B2
(45) Date of Patent: Nov. 16, 2021

(54) SLIDE, INFLATABLE WATER SLIDE AND POOL

(71) Applicant: BESTWAY INFLATABLES & MATERIAL CORP., Shanghai (CN)

(72) Inventors: Shuiyong Huang, Shanghai (CN); Patrizio Fumagalli, Shanghai (CN); Matthew Vartola, Shanghai (CN); John McBride, Shanghai (CN); Jiliang Liu, Shanghai (CN); Yuliang Jin, Shanghai (CN); Lei Zhang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 16/845,486

(22) Filed: Apr. 10, 2020

(65) Prior Publication Data

US 2020/0353371 A1 Nov. 12, 2020

(30) Foreign Application Priority Data

May 10, 2019 (CN) ..... 201920663485.0

(51) Int. Cl.
*A63G 21/18* (2006.01)
*A63G 31/12* (2006.01)
*A63G 31/00* (2006.01)

(52) U.S. Cl.
CPC ..... *A63G 21/18* (2013.01); *A63G 31/007* (2013.01); *A63G 31/12* (2013.01)

(58) Field of Classification Search
CPC ..... A63G 21/00; A63G 21/02; A63G 21/18; A63G 31/00; A63G 31/007
USPC ..... 472/117, 128, 129
See application file for complete search history.

(56) References Cited

U.S. PATENT DOCUMENTS

| | | | | |
|---|---|---|---|---|
| 6,062,983 | A | 5/2000 | Butsook | |
| 6,406,377 | B1 * | 6/2002 | Demko | A63G 21/18 472/116 |
| 9,511,298 | B2 * | 12/2016 | Sgromo | A63G 21/18 |
| 9,895,618 | B1 * | 2/2018 | Huang | A63G 21/18 |
| 2003/0027645 | A1 | 2/2003 | Gordon | |

(Continued)

OTHER PUBLICATIONS

Extended European Search Report dated Sep. 18, 2020 (dated Sep. 18, 2020) issued on related European Patent Application 2016844.6 by the European Patent Office.

*Primary Examiner* — Kien T Nguyen
(74) *Attorney, Agent, or Firm* — Dickinson Wright PLLC

(57) ABSTRACT

An inflatable water slide, an entertainment device, and a pool are provided. The water slide comprises a slide body that includes a first inflatable chamber having an inclined top surface. The water slide also includes a water spray device located on top of and extending along the inclined top surface of the slide body, and the water spray device is adapted to spray water onto the inclined top surface of the slide body. The entertainment device includes the inflatable water slide and an elongated slide sheet connected to the inflatable water slide. A pool may include the water slide of the present disclosure. The inflatable water slide, entertainment device, and pool of the present disclosure enable water to be sprayed onto the slide body more effectively than in conventional designs, thus preventing situations where water cannot be sprayed onto the slide body.

16 Claims, 7 Drawing Sheets

(56) References Cited

U.S. PATENT DOCUMENTS

| | | | |
|---|---|---|---|
| 2007/0101488 | A1 | 5/2007 | Ferraro |
| 2018/0280813 | A1 | 10/2018 | Huang |

* cited by examiner

SLIDE, INFLATABLE WATER SLIDE AND POOL

CROSS REFERENCE TO RELATED APPLICATIONS

This utility patent application claims the benefit and priority of Chinese patent application CN 201920663485.0, filed May 10, 2019, the full content of which is herein incorporated by reference.

TECHNICAL FIELD

The present disclosure relates to the technical field of inflatable products. More specifically, the present disclosure relates to an inflatable water slide.

BACKGROUND

Recreational activities with inflatable water slides, inflatable recreation pools and the like are popular children's summer activities.

Many entertainment devices include a slide sheet and a water slide that are fixed to the ground, as well as water spray pipes arranged along the sides of the slide sheet. Water spray pipes for such entertainment devices commonly include a number of water spray holes for spraying water streams onto the slide sheet and the slide to provide a wet and slippery surface. A user can run to the inflatable water slide and jump to throw himself/herself onto the slide or the slide sheet, and then slide along the slide sheet.

Conventional inflatable water slides can be adversely affected by changes in the water streams. For example, if the hydraulic pressure in the water spray pipes is too high or too low or the positions of the water spray holes are changed, the water streams can be redirected away from the slide, which can impair normal operation of the slide and/or the slide sheet.

SUMMARY

In accordance with various embodiments of the present disclosure, a water slide comprises a slide body including a first inflatable chamber having an inclined top surface. The water slide also includes a water spray device located on top of and extending along the inclined top surface of the slide body. The water spray device is adapted to spray water onto the inclined top surface of the slide body.

BRIEF DESCRIPTION OF THE DRAWINGS

To understand the present disclosure, it will now be described by way of example, with reference to the accompanying drawings in which implementations of the disclosure are illustrated and, together with the description below, serve to explain the principles of the disclosure.

DETAILED DESCRIPTION

The present disclosure provides exemplary embodiments of a water slide, and a pool fitted with such a water slide. The exemplary embodiments of the present disclosure are described below with reference to the drawings for illustration. It should be understood that the specific disclosed embodiments only illustrate exemplary implementations and uses of the present disclosure, but are not intended to limit the scope of the present disclosure. During description, the structural positions of various components, e.g., upper, lower, top, bottom, etc., are not absolute, but relative. The orientation expressions are appropriate when the various components are arranged as shown in the figures, but should change accordingly when the positions of the various components in the figures change. In this disclosure, the terms "upper", "lower", "left", "right", etc. are used for the convenience of description and are not restrictive.

The slide, inflatable water slide and pool of the present disclosure may provide one or more of the following advantages over conventional designs: the water slide enables water to be sprayed onto the slide body more effectively, and cases where water cannot be effectively sprayed onto the slide body can be avoided. The above advantages and other advantages and features will become apparent from the following detailed descriptions of exemplary embodiments and with reference to the accompanying drawings.

Figure 1:
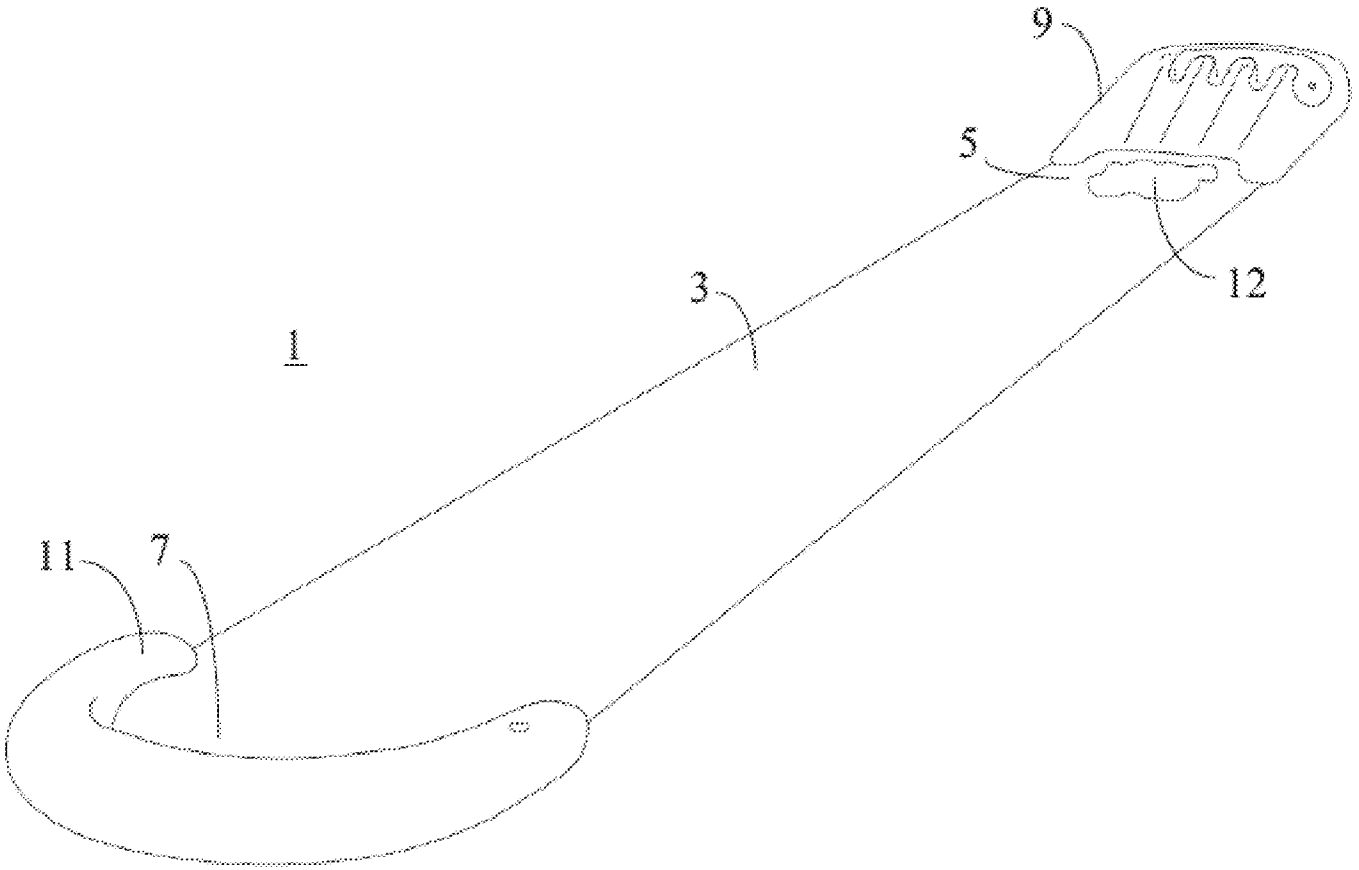
FIG. 1 is a perspective view of an exemplary entertainment device according to some embodiments of the present disclosure.

FIG. 1 is a perspective view of an exemplary entertainment device 1 according to some embodiments of the present disclosure. As shown in FIG. 1, the exemplary entertainment device 1 includes a slide sheet 3. The slide sheet 3 has an elongated shape and extends between a first end 5 and a second end 7 located opposite from the first end 5. The exemplary entertainment device 1 further includes a water slide 9 connected to the first end 5 of the slide sheet 3 and a stop portion 11 connected to the second end 7 of the slide sheet 3. When a user jumps or throws himself/herself onto the water slide 9 or the slide sheet 3 from a standing or running state, the water slide 9 can provide buffering for the user. The user can slide on the slide sheet 3 due to inertia. The stop portion 11 at the second end 7 of the slide sheet 3 can prevent the user from sliding beyond the second end 7 of the slide sheet 3. Moreover, the stop portion 11 may have certain elasticity and can provide certain buffering for the user to protect the user when the user stops sliding. In some embodiments, and as shown in FIG. 1, the exemplary entertainment device 1 includes a recess 12 located between the water slide 9 and the slide sheet 3. The recess 12 may fill with water, which can produce a splashing effect when a user slides, jumps, or throws himself/herself onto the slide sheet 3, thereby enhancing the user's experience.

Figure 2:
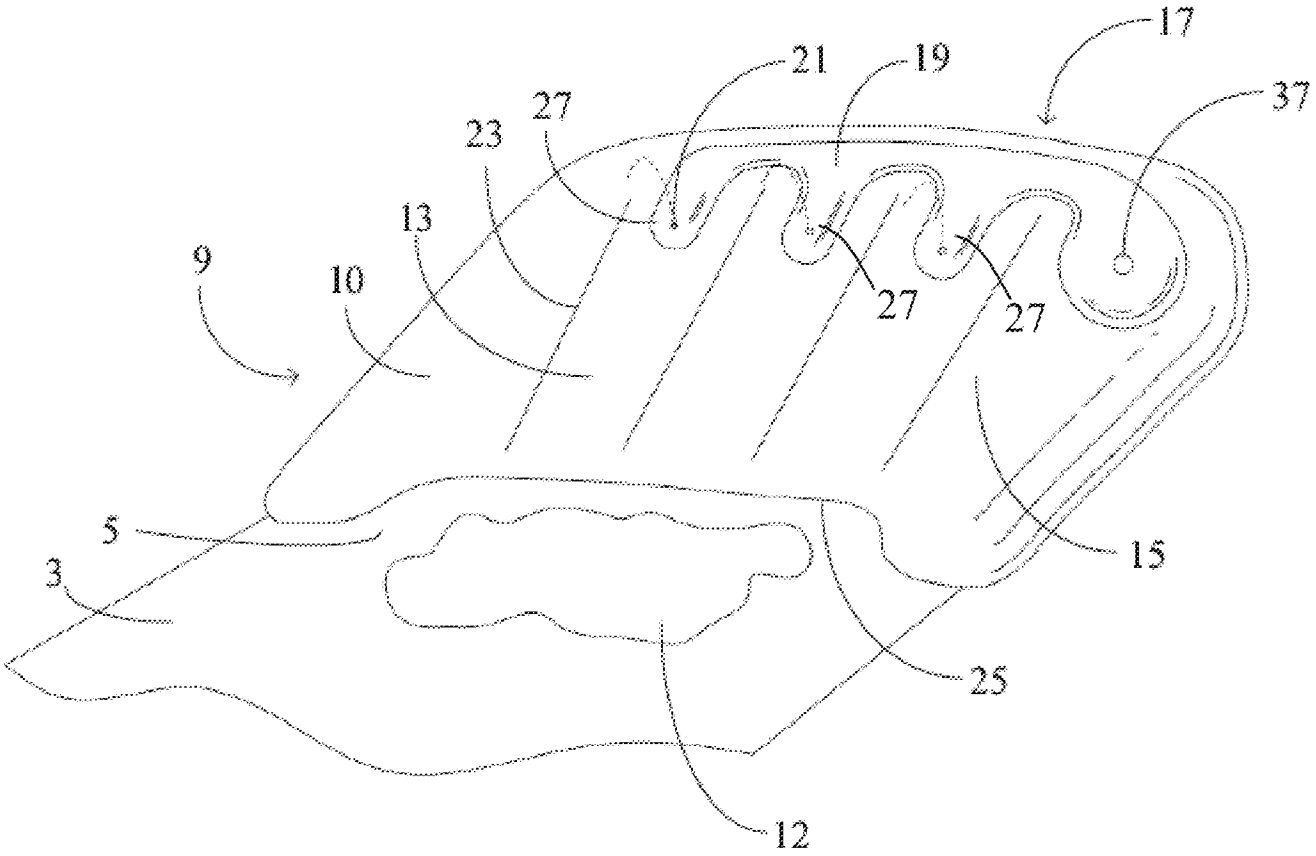
FIG. 2 is a perspective view of a water slide of the exemplary entertainment device according to some embodiments of the present disclosure.
Figure 3:
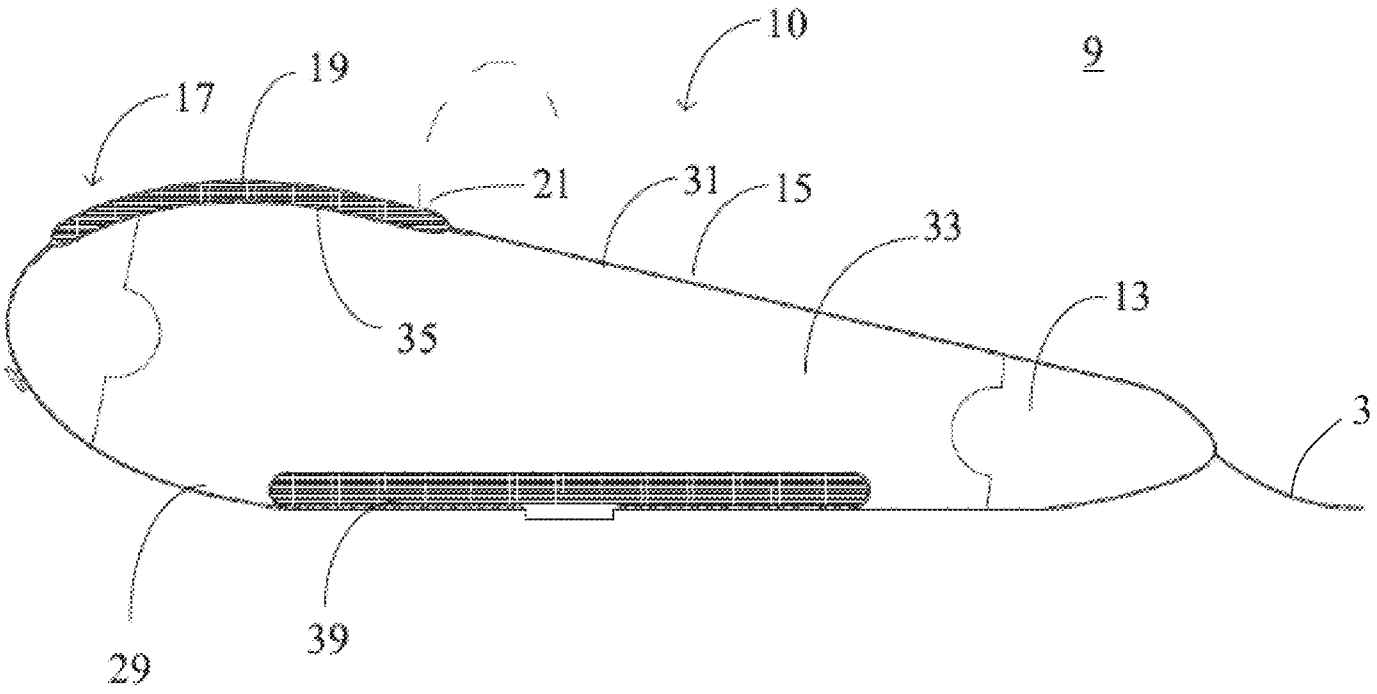
FIG. 3 is a cross-sectional view of the water slide of the exemplary entertainment device according to some embodiments of the present disclosure.

FIG. 2 is a perspective view of a water slide 9 of the exemplary entertainment device 1 according to some embodiments of the present disclosure. FIG. 3 is a cross-sectional view of the water slide 9 of the exemplary entertainment device 1 according to some embodiments of the present disclosure. As shown in FIGS. 2 and 3, the water slide 9 includes a slide body 10 and a water spray device 17. The slide body 10 includes a first inflatable chamber 13 configured to be inflated with air. The slide body 10 also includes an inclined top surface 15. The water spray device 17 is located on top of and extends along the inclined top surface 15 of the slide body 10, and the water spray device 17 is adapted to spray water onto the inclined top surface 15 of the slide body 10.

The water spray device 17 is arranged on the inclined top surface 15 of the slide body 10, and water sprayed from the water spray device 17 is sprayed toward the inclined top surface 15 of the slide body 10, so that the water can be sprayed onto the slide body 10 more effectively, and the undesirable scenario wherein water cannot be sprayed onto the slide body 10 is effectively avoided.

As shown in FIGS. 2 and 3, in order to spray more water onto the slide body 10, the water spray device 17 may be arranged on the top of the inclined top surface 15 of the slide body 10.

As shown in FIGS. 2 and 3, the water spray device 17 includes a second chamber 19 configured to convey water. The second chamber 19 defines a plurality of through holes 21 for spraying the water onto the inclined top surface 15 of the slide body 10 from the second chamber 19 via the plurality of through holes 21. In some embodiments, the second chamber 19 extends along the inclined top surface 15 adjacent to or near an upper edge of the inclined top surface 15. In some embodiments, the second chamber 19 extends transverse to a sliding direction, where the sliding direction is a direction of travel of a user sliding down the inclined top surface 15.

The water spray device 17 is connected to a provided water supply source (not shown). The provided water supply source provides pressurized water having a degree of hydraulic pressure. The second chamber 19 is filled with the pressurized water. In addition, due to the hydraulic pressure, the pressurized water is sprayed out from the through holes 21 of the second chamber 19 and forms water streams. Since the second chamber 19 is arranged on the inclined top surface 15 of the slide body 10, the water streams are first sprayed out in a direction substantially perpendicular to the inclined top surface 15 of the slide body 10. Subsequently, under the action of gravity, the water streams form parabolic shapes and are sprayed onto the slide body 10. This type of water spray device 17 is relatively simple in structure and can effectively ensure that the water streams are sprayed onto the slide body 10. In the illustrated embodiment, the second chamber 19 defines three through holes 21. It should be understood that the second chamber 19 may include any number of through holes 21, and that the number of through holes 21 may be selected according to various design requirements.

As shown in FIG. 2, the inclined top surface 15 of the slide body 10 defines a plurality of elongated recessed portions 23, and each of the through holes 21 is positioned midway between a corresponding pair of adjacent elongated recessed portions 23. The elongated recessed portions 23 extend substantially along the inclined direction (i.e., the sliding direction of a user) of the inclined top surface 15 of the slide body 10 toward the first end 5 of the slide sheet 3. Thus, after the water streams sprayed out from the through holes 21 are sprayed onto the inclined top surface 15 of the slide body 10, the water flow can converge into the elongated recessed portions 23 on the two respective sides of each through hole 21. The water can then flow along the elongated recessed portions 23 toward the first end 5 of the slide sheet 3. The water may flow, for example, into the recess 12 close to the first end 5 of the slide sheet 3. As shown in FIG. 2, the water slide 9 defines a notch 25 at the junction with the first end 5 of the slide sheet 3. The notch 25 is configured for holding water therein, and the water sprayed out from the water spray device 17 can converge in the notch 25.

In some embodiments, and as shown in FIG. 2, the second chamber 19 includes a plurality of extending portions 27, with each of the extending portions 27 extending parallel to the sliding direction. In some embodiments, each of the extending portions 27 defines one or more of the through holes 21. More specifically, and as shown in FIG. 2, each of the extending portions 27 may define one of the through holes 21 at or near a lower end thereof. Each of the extending portions 27 extends between two adjacent elongated recessed portions 23, and each through hole 21 of the plurality of through holes 21 is located in a corresponding one of the plurality of extending portions 27. In some embodiments, and as shown in FIG. 2, the second chamber 19 includes three extending portions 27, and each of the through holes 21 are respectively arranged in a corresponding extending portion 27. However, the second chamber 19 may include any number of extending portions 27. The second chamber 19 provides each of the extending portions 27 located between a corresponding pair of adjacent elongated recessed portions 23 that are adjacent to one another, so that the water streams can be directed from the through holes 21 and onto raised portions of the inclined top surface 15 between corresponding adjacent pairs of the elongated recessed portions 23, from which the water can flow into the elongated recessed portions 23 on either side of the raised portions.

As shown in FIG. 3, the first inflatable chamber 13 includes a lower sheet 29 and an upper sheet 31, and the upper sheet 31 defines the inclined top surface 15. The first inflatable chamber 13 includes a plurality of tension members 33. An upper edge of each of the tension members 33 is connected to the upper sheet 31 of the first inflatable chamber 13 to form a corresponding elongated recessed portion 23, and a lower edge of each of the tension members 33 is connected to the lower sheet 29 of the first inflatable chamber 13. The plurality of tension members 33 extending between the upper sheet 31 and the lower sheet 29 of the first inflatable chamber 13 can effectively define a shape of the first inflatable chamber 13. The plurality of tension members 33 can also improve the structural strength of the first inflatable chamber 13. The plurality of tension members 33 also function to define the elongated recessed portions 23 on the inclined top surface 15 of the slide body 10 after the first inflatable chamber 13 is inflated, thus facilitating convergence of the water flow therein.

As shown in FIG. 3, the second chamber 19 is confined by the upper sheet 31 of the first inflatable chamber 13 and a sheet 35 connected to the upper sheet 31 of the first inflatable chamber 13. The sheet 35 may be connected to an outer side of the upper sheet 31, thus defining the second chamber 19 outside of the first inflatable chamber 13. Alternatively, the sheet 35 may be connected to an inner side of the upper sheet 31, thus defining the second chamber 19 inside of the first inflatable chamber 13. The connection of the upper sheet 31 and the sheet 35 to confine the second chamber 19 can simplify the structure, save on materials, and lower the cost when compared with alternate designs that do not incorporate the upper sheet 31 to separate the first inflatable chamber 13 from the second chamber 19. It should be understood that the second chamber 19 may alternatively comprise a separate chamber that is connected to the first inflatable chamber 13 in a different way that does not share use of the upper sheet 31.

As shown in FIG. 2, the water spray device 17 includes a water valve 37, and the water valve 37 is adapted to connect the second chamber 19 to a provided water supply source. The water valve 37 can be utilized to control turning on and off of water from the provided water supply source, and can also control the pressure and flow rate of water to facilitate more effective spraying of water onto the slide body 10.

As shown in FIG. 3, the slide body 10 includes a third chamber 39 located at the bottom of the first inflatable chamber 13. In some embodiments, the third chamber 39 is configured to be filled with water. When filled with water, the third chamber 39 can stabilize the water slide 9, thereby stabilizing the exemplary entertainment device 1 and preventing the exemplary entertainment device 1 from being blown away by wind.

Figure 4:
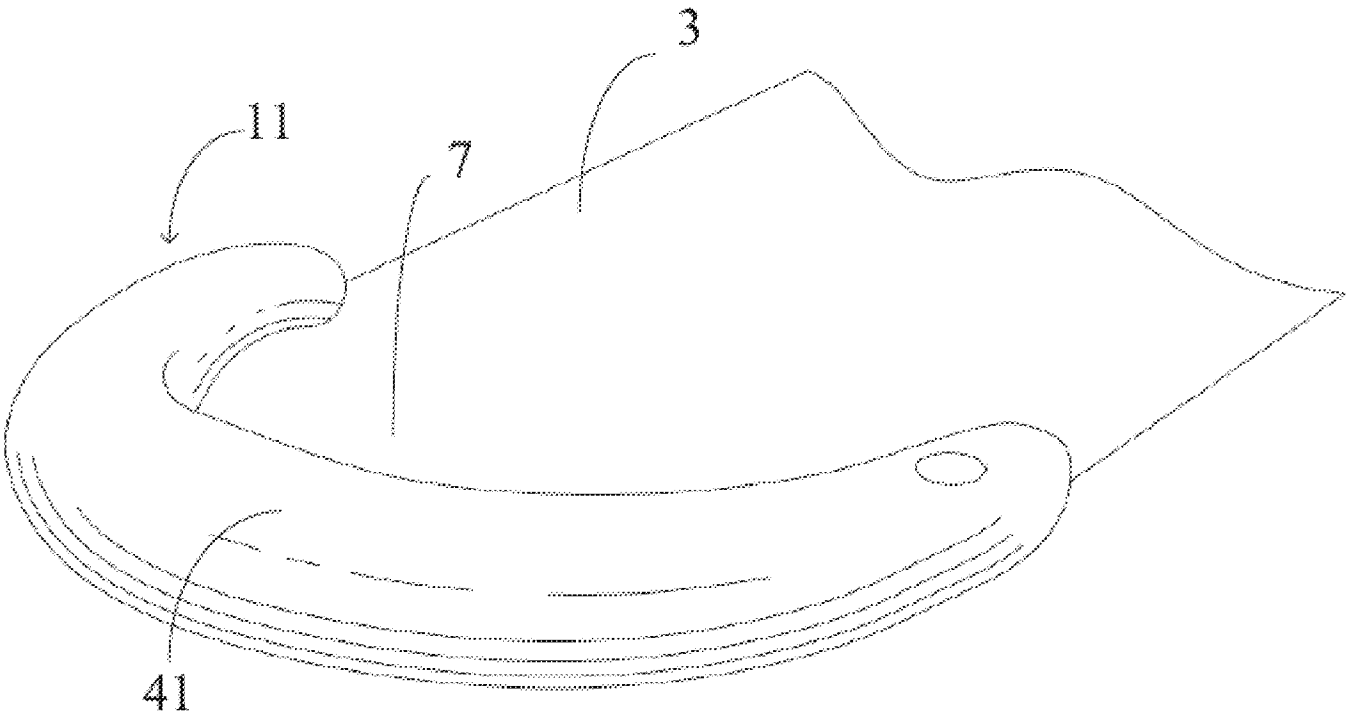
FIG. 4 is a perspective view of a stop portion of the exemplary entertainment device according to some embodiments of the present disclosure.

FIG. 4 is a perspective view of a stop portion 11 of the exemplary entertainment device 1 according to some embodiments of the present disclosure. Specifically, FIG. 4 shows the stop portion 11 connected to the second end 7 of the slide sheet 3. As shown in FIG. 4, the stop portion 11 includes a fourth chamber 41 configured to be filled with water. When in use, the fourth chamber 41 is filled with water to stabilize the stop portion 11, thereby stabilizing the exemplary entertainment device 1 and preventing the exemplary entertainment device 1 from being blown away by wind.

The water slide 9 and the stop portion 11 may be connected to the slide sheet 3 by high frequency welding, bonding or the like. However, the water slide 9 and the stop portion 11 may be connected by any other means or techniques. The water slide 9, the stop portion 11 and the slide sheet 3 may be made of plastic materials, PVC (polyvinyl chloride) materials, thermoplastic elastomer materials, etc. Any or all of the water slide 9, the stop portion 11 and/or the slide sheet 3 may be made of other synthetic or natural materials.

Figure 5:
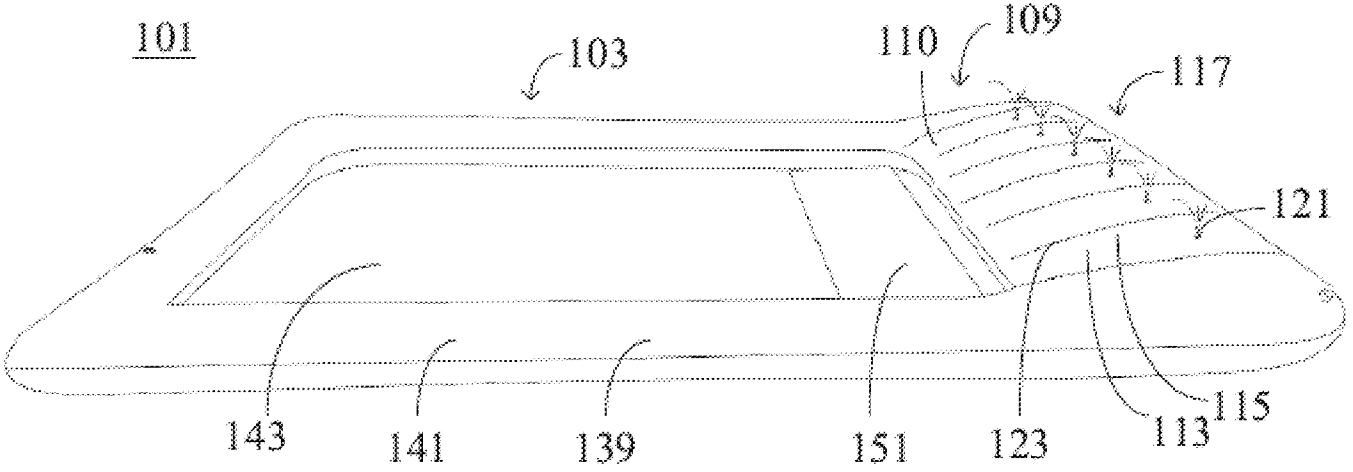
FIG. 5 is a perspective view of an exemplary pool according to some embodiments of the present disclosure.

FIG. 5 is a perspective view of an exemplary pool 101 according to some embodiments of the present disclosure. As shown in FIG. 5, the pool 101 includes a pool body 103 and a water slide 109. The pool body 103 is connected to the water slide 109. Users may play or swim within the pool body 103. Users may jump or slide into the pool body 103 using the water slide 109, which enhances the user experience.

Figure 6:
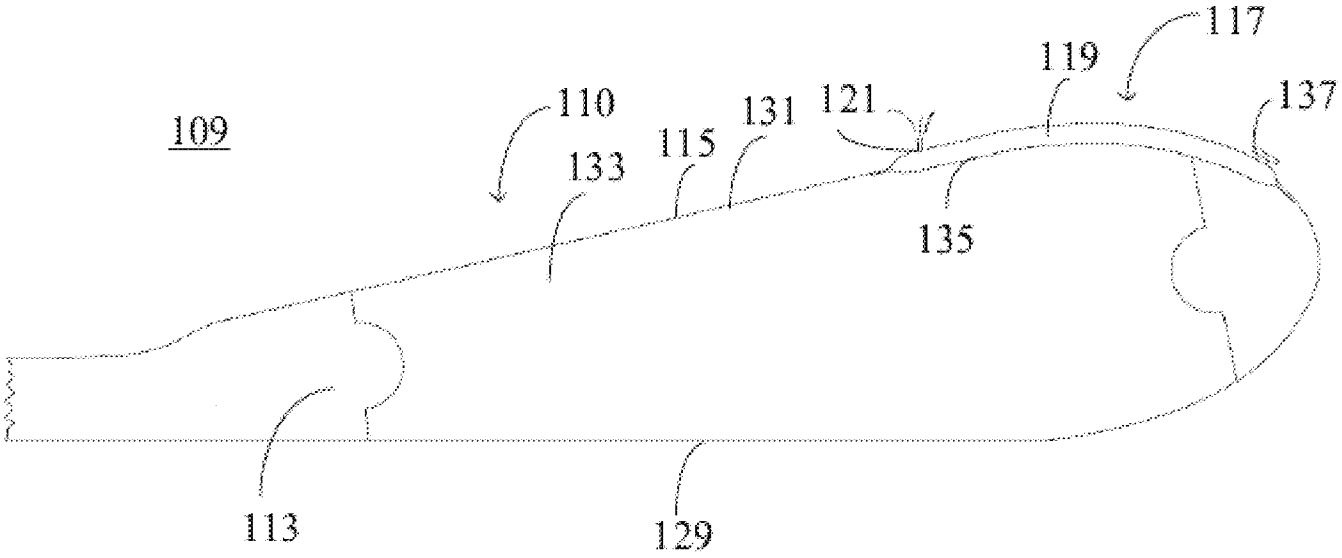
FIG. 6 is a cross-sectional view of a water slide of the exemplary pool according to some embodiments of the present disclosure.

FIG. 6 is a cross-sectional view of the water slide 109 of the exemplary pool 101 according to some embodiments of the present disclosure. As shown in FIGS. 5 and 6, the water slide 109 includes a slide body 110 and a water spray device 117. The slide body 110 includes a first inflatable chamber 113 for inflation, and the slide body 110 includes an inclined top surface 115. The water spray device 117 is arranged on the inclined top surface 115 of the slide body 110, and the water spray device 117 can spray water onto the inclined top surface 115 of the slide body 110.

The water spray device 117 is arranged on the inclined top surface 115 of the slide body 110, and water sprayed from the water spray device 117 is sprayed toward the inclined top surface 115 of the slide body 110, so that the water can be sprayed onto the slide body 110 more effectively, and the undesirable scenario wherein water cannot be sprayed onto the slide body 110 is effectively avoided.

The water spray device 117 may be arranged on the top of the inclined top surface 115 of the slide body 110, as shown in FIGS. 5 and 6, in order to spray water onto the slide body 110.

As shown in FIGS. 5 and 6, the water spray device 117 includes a second chamber 119 configured to convey water, and the second chamber 119 defines a plurality of through holes 121 such that the water is sprayed onto the inclined top surface 115 of the slide body 110 from the second chamber 119 via the plurality of through holes 121. The water spray device 117 is connected to a provided water supply source (not shown). The provided water supply source provides water with certain hydraulic pressure. The second chamber 119 is filled with the pressurized water. In addition, due to the hydraulic pressure, the pressurized water is sprayed out from the through holes 121 of the second chamber 119 and forms water streams. Since the second chamber 119 is arranged on the inclined top surface 115 of the slide body 110, the water streams are first sprayed out in a direction substantially perpendicular to the inclined top surface 115 of the slide body 110. Subsequently, under the action of gravity, the water streams form parabolic shapes and are sprayed onto the slide body 110. This type of water spray device 117 is relatively simple in structure, and can effectively ensure that the water streams are sprayed onto the slide body 110. In the illustrated embodiment, the second chamber 119 defines six through holes 121. It should be understood that the second chamber 119 may define any number of through holes 121, and the number of through holes 121 may be selected according to actual needs.

As shown in FIG. 5, the inclined top surface 115 of the slide body 110 defines a plurality of elongated recessed portions 123, and each of the through holes 121 is positioned midway between a corresponding pair of adjacent recessed portions 123. The elongated recessed portions 123 extend substantially along the inclined direction (i.e. the sliding direction of a user) of the inclined top surface 115 of the slide body 110 toward the pool body. Thus, after the water streams sprayed out from the through holes 121 are sprayed onto the inclined top surface 115 of the slide body 110, the water flow can converge into the elongated recessed portions 123 on the two respective sides of each through hole 121. The water can then flow along the elongated recessed portions 123 to the pool body 103.

Figure 7:
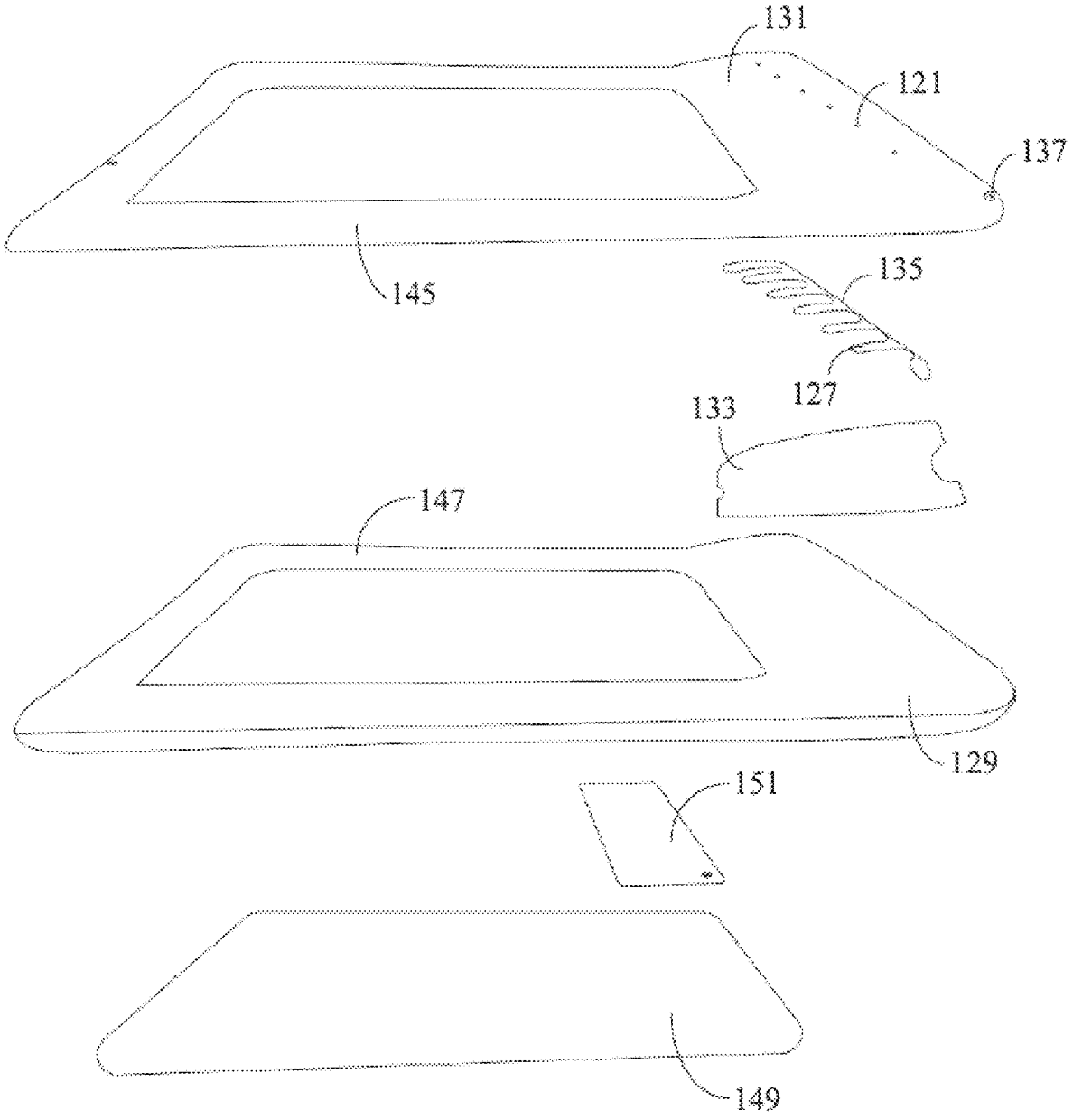
FIG. 7 is an exploded view showing the exemplary pool according to some embodiments of the present disclosure.

FIG. 7 is an exploded view showing the exemplary pool 101 according to some embodiments of the present disclosure. As shown in FIGS. 5 and 7, the second chamber 119 includes a plurality of extending portions 127, each extending portion 127 of the plurality of extending portions 127 extends between two adjacent elongated recessed portions 123, and each through hole 121 of the plurality of through holes 121 is located in a corresponding one of the plurality of extending portions 127. In the illustrated embodiment, the second chamber 119 includes six extending portions 127, and the six through holes 121 are located in corresponding extending portions 127, respectively. However, the second chamber 119 may include any number of extending portions 127. The second chamber 119 provides each of the extending portions 127 located between a corresponding pair of adjacent elongated recessed portions 123 that are adjacent to one another, so that the water streams can be directed from the through holes 121 and onto raised portions of the inclined top surface 115 between corresponding adjacent pairs of the elongated recessed portions 123, from which the water can flow into the elongated recessed portions 123 on either side of the raised portions.

As shown in FIG. 6, the first inflatable chamber 113 includes a lower sheet 129 and an upper sheet 131 that defines the inclined top surface 115. The first inflatable chamber 113 includes a plurality of tension members 133. An upper edge of each of the tension members 133 is connected to the upper sheet 131 of the first inflatable chamber 113 to form a corresponding elongated recessed portion 123, and a lower edge of each of the tension members 133 is connected to the lower sheet 129 of the first inflatable chamber 113. The plurality of tension members 133 extending between the upper sheet 131 and the lower sheet 129 of the first inflatable chamber 113 can effectively define a shape of the first inflatable chamber 113. The plurality of tension members 133 can also improve the structural strength of the first inflatable chamber 113. The plurality of tension members 133 also function to define the elongated recessed portions 123 on the inclined top surface 115 of the slide body 110 after the first inflatable chamber 113 is inflated, thus facilitating convergence of the water flow therein.

As shown in FIG. 6, the second chamber 119 is confined by the upper sheet 131 of the first inflatable chamber 113 and a sheet 135 connected to the upper sheet 131 of the first inflatable chamber 113. The sheet 135 may be connected to an outer side of the upper sheet 131, thus defining the second chamber 119 outside of the first inflatable chamber 113. Alternatively, the sheet 135 may be connected to an inner side of the upper sheet 131, thus defining the second chamber 119 inside of the first inflatable chamber 113. The connection of the upper sheet 131 and the sheet 135 to confine the second chamber 119 can simplify the structure, save on materials, and lower the cost when compared with alternate designs that do not incorporate the upper sheet 131 to separate the first inflatable chamber 113 from the second chamber 119. It should be understood that the second chamber 119 may alternatively comprise a separate chamber that is connected to the first inflatable chamber 113 in a different way that does not share use of the upper sheet 131.

As shown in FIG. 6, the water spray device 117 includes a water valve 137, and the water valve 137 is adapted to connect the second chamber 119 to a provided water supply source. The water valve 137 can be utilized to control turning on and off of water from the provided water supply source, and can also control the pressure and flow rate of water to facilitate more effective spraying of water onto the slide body 110.

As shown in FIG. 5, the pool body 103 includes a fifth inflatable chamber 139 in fluid communication with the first inflatable chamber 113 of the water slide 109. Thus, the pool body 103 and the water slide 109 are provided as one air chamber, so that the inflation is convenient and quick.

As shown in FIGS. 5 and 7, the pool body 103 includes a pool wall 141 and a pool bottom 143, the pool wall 141 including a first wall sheet connected to a second wall sheet to form the fifth inflatable chamber 139. The first and second wall sheets may be a pool wall upper sheet 145 and a pool wall lower sheet 147, respectively. However, the first and second wall sheets may have any other configuration, such as two generally upright sheets. The pool bottom 143 includes a bottom sheet 149 which is connected to the pool wall 141. The pool body 103 may be simple in structure and convenient for processing.

In some embodiments, and as shown in FIGS. 5 and 7, the slide body 110 is formed by the first and second wall sheets of the pool wall 141. More specifically, the slide body 110 is formed by extending and connecting the pool wall upper sheet 145 and the pool wall lower sheet 147. Specifically, the pool wall upper sheet 145 extends to form the upper sheet 131 of the first inflatable chamber 113 of the slide body 110, and the pool wall lower sheet 147 extends to form the lower sheet 129 of the first inflatable chamber 113 of the slide body 110. Thus, the pool body 103 and the water slide 109 form an integrated structure, and have inflatable chambers communicating with each other, so the process is simple, the cost is low, the slide is not required to be mounted and fixed before use, and the mounting requires less time and labor.

As shown in FIGS. 5 and 7, the pool body 103 further includes a landing cushion 151 located on the pool bottom 143 near the slide body 110. The landing cushion 151 can provide a soft landing for the user when sliding into the pool. The landing cushion 151 may be adapted to be at least partially filled with at least one of water or air. In some embodiments, the landing cushion 151 may be adapted to be filled with both water and air, which may be in two separate chambers or in a combined chamber.

It should be understood that the pool wall upper sheet 145, the pool wall lower sheet 147, the bottom sheet 149 and the landing cushion 151 of the pool body 103, as well as the upper sheet 131, the lower sheet 129, the sheet 135 and the tension members 133 of the water slide 109 may be connected by high frequency welding, bonding or the like. The pool body and the slide may be made of plastic materials, PVC (polyvinyl chloride) materials, thermoplastic elastomer materials, etc.

Although some embodiments have been described by way of examples herein, various variations could be made to these embodiments without departing from the spirit of the present disclosure. All such variations belong to the conception of the present disclosure and fall within the scope of protection defined by the claims of the present disclosure. The specific embodiments disclosed herein are merely illustrative of the present disclosure. It would be apparent to those skilled in the art that various modifications could be made according to the teachings of the present disclosure and the present disclosure could be practiced in various equivalent ways. Thus, the particular embodiments of the present invention disclosed above are illustrative only, and the scope of protection of the present disclosure is not limited by the details of the structures or designs disclosed herein. Accordingly, various substitutions, combinations, or modifications could be made to the particular exemplary embodiments disclosed herein, and all variations thereof fall within the scope of the present disclosure. The water slide, entertainment device, and pool exemplarily disclosed herein may also be suitably practiced in the absence of any element not specifically disclosed herein or in the absence of any optional components disclosed herein.

What is claimed is:

1. A water slide, comprising:

a slide body comprising a first chamber, the first chamber being inflatable and comprising:

an upper sheet defining an inclined top surface; and a lower sheet; and a water spray device disposed along the inclined top surface of the slide body, the water spray device comprising:

a second chamber configured to convey water and defining a plurality of through holes configured to spray water onto the inclined top surface of the slide body, the second chamber defined by the upper sheet of the first chamber and a sheet connected to the upper sheet of the first chamber.

2. The water slide of claim 1, wherein the second chamber is disposed adjacent to an upper edge of the inclined top surface and extends along the inclined top surface transverse to a sliding direction.

3. The water slide of claim 1, wherein the inclined top surface of the slide body defines a plurality of elongated recessed portions, and each of the plurality of through holes is positioned between a corresponding pair of elongated recessed portions.

4. The water slide of claim 3, wherein the second chamber comprises a plurality of extending portions, each of the plurality of extending portions disposed between a corresponding pair of elongated recessed portions, and each of the plurality of extending portions defining a through hole of the plurality of through holes.

5. The water slide of claim 3, wherein the first chamber further comprises a plurality of tension members, an upper edge of each of the plurality of tension members connected to the upper sheet of the first chamber, thereby forming a corresponding one of the plurality of elongated recessed portions, and a lower edge of each of the plurality of tension members connected to the lower sheet of the first chamber.

6. The water slide of claim 1, the water spray device further comprising a water valve configured to connect the second chamber to a water supply source.

7. The water slide of claim 1, wherein the slide body further comprises a third chamber disposed at a bottom of the first chamber and configured to be filled with water.

8. An entertainment device comprising:

the water slide of claim 1; and a slide sheet comprising a first end and a second end, opposite the first end, the water slide being connected to the first end of the slide sheet.

9. The entertainment device of claim 8, further comprising:

a stop portion connected to the second end of the slide sheet, the stop portion comprising a fourth chamber configured to be filled with water.

10. A pool comprising the water slide of claim 1.

11. The pool of claim 10, further comprising:

a pool body comprising: a pool wall, a pool bottom, and a fifth chamber in communication with the first chamber.

12. The pool of claim 11, further comprising:

a slide sheet comprising a first end connected to the water slide and a second end, opposite the first end; and a stop portion connected to the second end of the slide sheet, the stop portion comprising a fourth chamber configured to be filled with water;

wherein the pool wall comprises a first wall sheet connected to a second wall sheet, thereby forming the fifth chamber between the first wall sheet and the second wall sheet, the fifth chamber being inflatable.

13. The pool of claim 11, wherein the pool bottom comprises a bottom sheet connected to the pool wall.

14. The pool according to claim 11, further comprising a landing cushion disposed on the pool bottom and configured to be at least partially filled with at least one of water or air.

15. A water slide comprising:

a slide body comprising a first chamber, the first chamber being inflatable and having an inclined top surface; and a water spray device disposed along the inclined top surface of the slide body, the water spray device comprising:

a second chamber configured to convey water and defining a plurality of through holes configured to spray water onto the inclined top surface of the slide body, the second chamber comprising a plurality of extending portions, each of the plurality of extending portions extending parallel to a sliding direction.

16. A pool comprising:

a pool bottom;

an inflatable pool wall, connected to the pool bottom, comprising a first wall sheet connected to a second wall sheet, thereby forming an inflatable wall chamber therebetween; and a water slide comprising:

an inclined top surface comprising a portion of the first wall sheet of the inflatable pool wall; and a water spray device disposed along the inclined top surface and configured to spray water onto the inclined top surface of the water slide.

* * * * *